US007407242B2

(12) United States Patent
Piatt et al.

(10) Patent No.: US 7,407,242 B2
(45) Date of Patent: Aug. 5, 2008

(54) DERIVATION OF MULTICOLOR TEXT COLORANT LIMITS FROM SINGLE COLOR TEXT COLORANT LIMIT

(75) Inventors: Michael J. Piatt, Dayton, OH (US); Joseph P. Mangan, Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 732 days.

(21) Appl. No.: 10/839,618

(22) Filed: May 5, 2004

(65) Prior Publication Data

US 2005/0248598 A1 Nov. 10, 2005

(51) Int. Cl.
*B41J 2/195* (2006.01)

(52) U.S. Cl. ..... 347/7; 358/1.9; 358/3.26; 347/2

(58) Field of Classification Search ..... 347/7, 347/2; 359/1.9; 358/1.9, 3.26
See application file for complete search history.

(56) References Cited

U.S. PATENT DOCUMENTS

2004/0114158 A1 * 6/2004 Klassen et al. ..... 358/1.9

* cited by examiner

*Primary Examiner*—King Y. Poon
*Assistant Examiner*—Quang N. Vo
(74) *Attorney, Agent, or Firm*—Buskop Law Group, PC

(57) ABSTRACT

The method for a printing device determines the maximum amount of colorant that is to be deposited on a specific region of print media to form an image with a reduced quantity of visual defects. The method entails inputting at least one colorant value on the specific region of print media. The at least one colorant value indicates a total amount of at least one colorant that is to be applied by the printing device. A colorant limit is derived for each color or combinations thereof according to a text ink limit algorithm and each derived color ink limit is applied to the image to limit the quantity of ink used by the printing device when one of the derived colorant limits is exceeded.

17 Claims, 5 Drawing Sheets

DERIVATION OF MULTICOLOR TEXT COLORANT LIMITS FROM SINGLE COLOR TEXT COLORANT LIMIT

CROSS REFERENCES TO RELATED APPLICATIONS

FIELD OF THE INVENTION

The present embodiments relate to methods for processing of digital data purposed for output to an inkjet printing device.

BACKGROUND OF THE INVENTION

Inkjet printing typically involves the use of water based inks. These water based inks interact with papers differently than inks used in other printing systems such as web offset printing. In particular, water based inks can cause print defects, such as bleed and mottle, and can cause paper deformities, such as cockle, curl, and show through of the text onto the opposite side of the page. These defects result in a need to limit the total amount of ink applied to the paper per unit area of a printed image. This limitation is often referred to as the upper ink limit (UIL) used for data processing for the printing system. The UIL necessary for one paper may not be the same as that appropriate for another paper, due to differences in paper type, weight, and coating. Thus, for each paper used on a given inkjet printing system, a different UIL needs to be specified by the user.

In the field of production printing, the ability to print text of various hues and saturations is commonly desirable. In order to achieve this range of colors, text may be printed using one or more colors of ink. Most commonly, process color prints are made using four inks: cyan, magenta, yellow, and black. Due to the defects mentioned above and the fine level of detail needed to render smaller point sizes of text and certain fonts with small features such as serifs, all possible ink loadings are not always acceptable. In particular, higher ink loads often result in printing defects, such as "ink bleed" that may cause small point sizes of text to be of unacceptably low quality or entirely illegible. The UIL allowable for text is partly dependent on the particular font and point size of the text, as well as the particular paper stock used for printing.

Typically, print defects are avoided by limiting the amount of ink that is used when printing smaller point sizes of text. The use a single ink limit for all colors of text is not often the most effective approach because when more than one color of ink is used for a particular text color a higher level of total ink might be permitted than for a text color that is created using only a single color of ink. The press operator or graphic designer may, therefore, specify several different total ink limits for small sizes of text based on whether the text is composed of one or more colors of ink. Empirically determining each of these limits for each paper and system configuration can be a tedious process.

A need exists for a series of steps to derive automatically the total ink limits of multi-ink texts using user supplied limits for text colors composed of just one or two inks. A need exists for a series of steps that enable the automatic adjustment of data coming into an ink jet printer and the use of these derived limits saving a user time and money for manually inputting two ink limits. A need has existed for a user to simply input one or two values for single and two-ink limits derive the remaining ink limits and apply all these ink limits to all parts of a print job regardless of size. The present methods meet these needs and save a user a significant amount of time and labor

SUMMARY OF THE INVENTION

The method for a printing device is used to determine the maximum amount of colorant to be deposited on a specific region of print media in order to form an image with a reduced quantity of visual defects. Initially, a single colorant value is input on the specific region of print media. The single colorant value indicates a total amount of single colorant that is to be applied by the printing device. The method then entails deriving a colorant limit for each color or combinations thereof according to a text ink limit algorithm, and applying each derived color ink limit to the image to limit the quantity of ink used by the printing device when one of the derived colorant limits is exceeded.

BRIEF DESCRIPTION OF THE DRAWINGS

In the detailed description of the preferred embodiments presented below, reference is made to the accompanying drawings, in which.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

In many printing systems, printing small point size text using the full amount of ink available on an ink jet printing system is not always possible. The ink and substrate frequently interact causing a maximum ink limit for small subject matter on certain types of substrates.

Typically, if a single primary color can print at X % ink coverage, secondary colors can usually be printed at Y % ink coverage, wherein Y is a value greater than X. A higher ink limit may be allowed if the two inks are applied at two different times. Similarly, three-color text can be printed at a higher percentage than two color text if printed sequentially. The embodied methods allow a user to derive all of the appropriate ink levels for a specific paper or other print media, with input from the user defining only one or two of the actual ink limit levels.

The present methods were created to limit the amount of visual defects in resulting printed images using an automatic system that requires little user input in order to quickly create a higher quality image as compared with existing systems.

The embodied methods provide for the automatic determination of text ink limits for the printing of multi-ink text given user input about only one or at the most two ink limits or a given text or font or image size with given types of media.

This automatic determination method uses a particular sequence of steps to compute the multi-ink text ink limits that is dependent on the particular printing system, the typical inks, and the selected print media substrate selected for use with that system. Given a particular printing system and samples of various media and ink associated with the system, the method uses a sequence of steps to predict the ink limits of text for a particular substrate composed of multiple inks using only one or two ink limit values.

Figure 1:
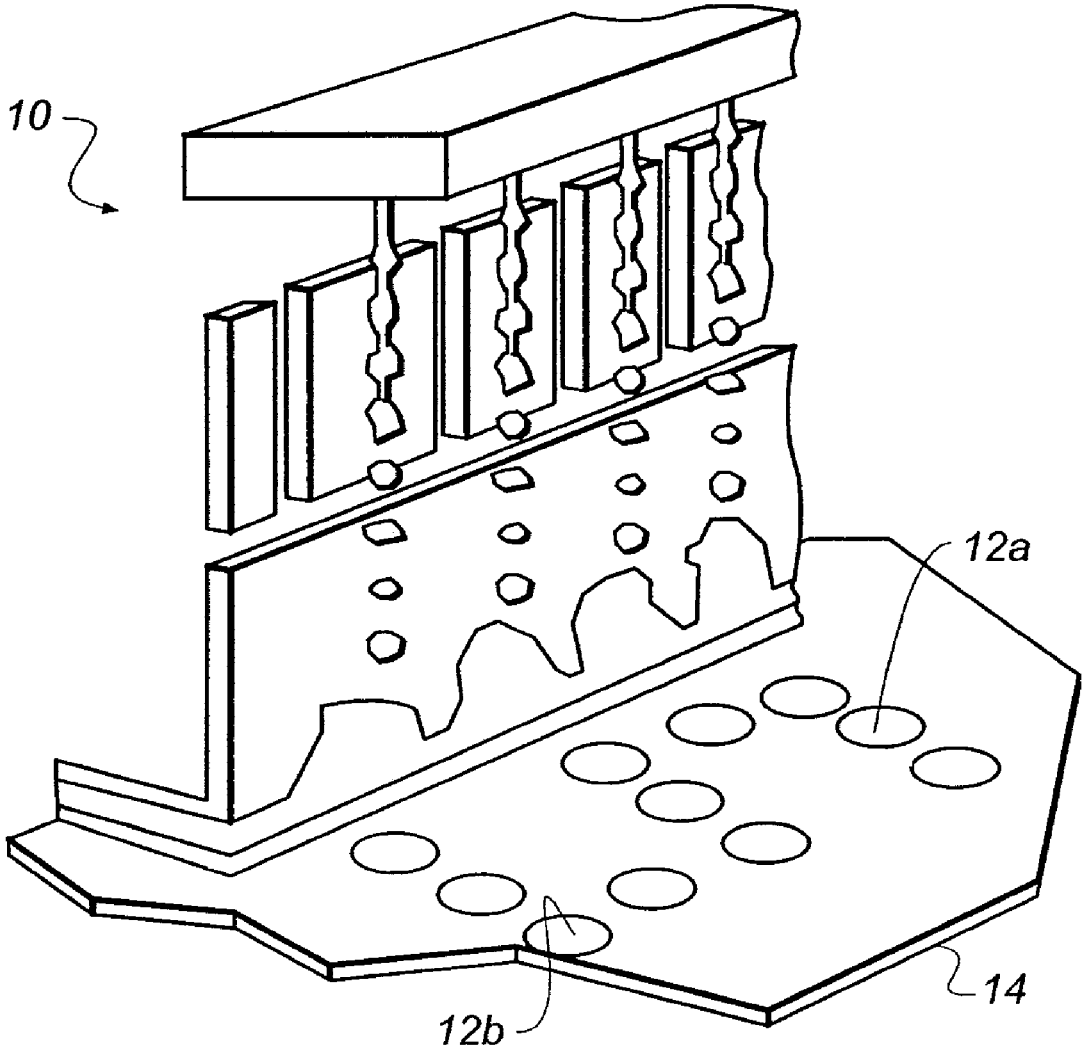
FIG. 1 depicts a side view of a printing device using an embodied method.

With reference to the figures, FIG. 1 depicts a side exploded view of a printing device 10 using an embodiment of the method for determining the maximum amount of colorant that can be deposited on a specific region 12*a* and 12*b* of print media 14 to form an image with a reduced quantity of visual defects. An example of an ink jet print station is a Kodak Versamark DT92 print station available from Kodak Versamark of Dayton, Ohio.

Figure 2:
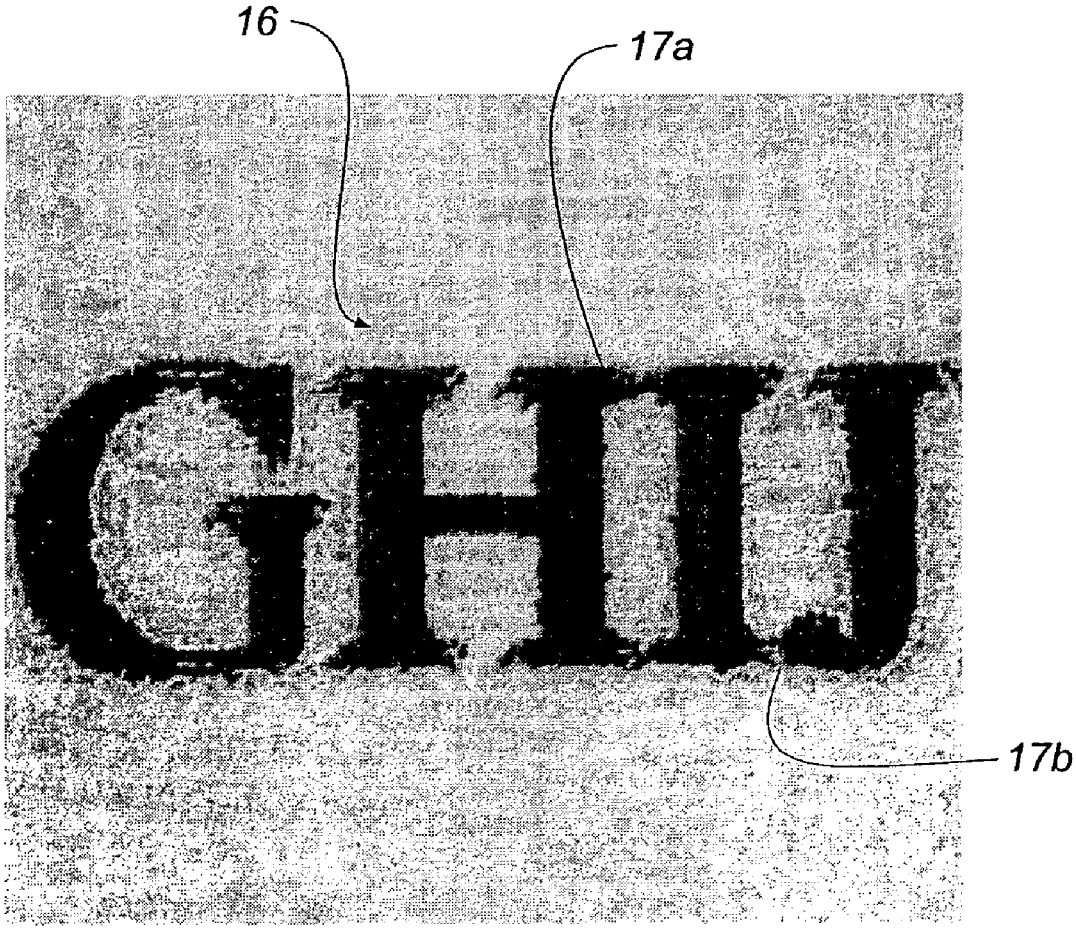
FIG. 2 depicts a top view of a printed image with visual defects that are reduced using an embodied method.

FIG. 2 shows an image 16 formed from conventional methods of using ink limits with visual defects 17*a* and 17*b*.

Visual defects include defects from colorant bleeding, print media deformation, show through defect, over saturation of colorant, mottle and the like. Bleeding defect occurs when the ink runs together or is diffused out of the specified region. Mottle defects are the appearance of spotty or uneven printing, most commonly in solid areas. Show-through defects and printings that are visible from the back side of a print media or from the next print media under normal lighting conditions. Wrinkles, with respect to ink, are defects in an uneven surface formed from drying. FIG. 2 shows the type of printed output that can be produced when the appropriate ink limits are not used to print multi-ink text. The ink in the text has bled significantly. In some cases, such text is entirely illegible.

Figure 3:
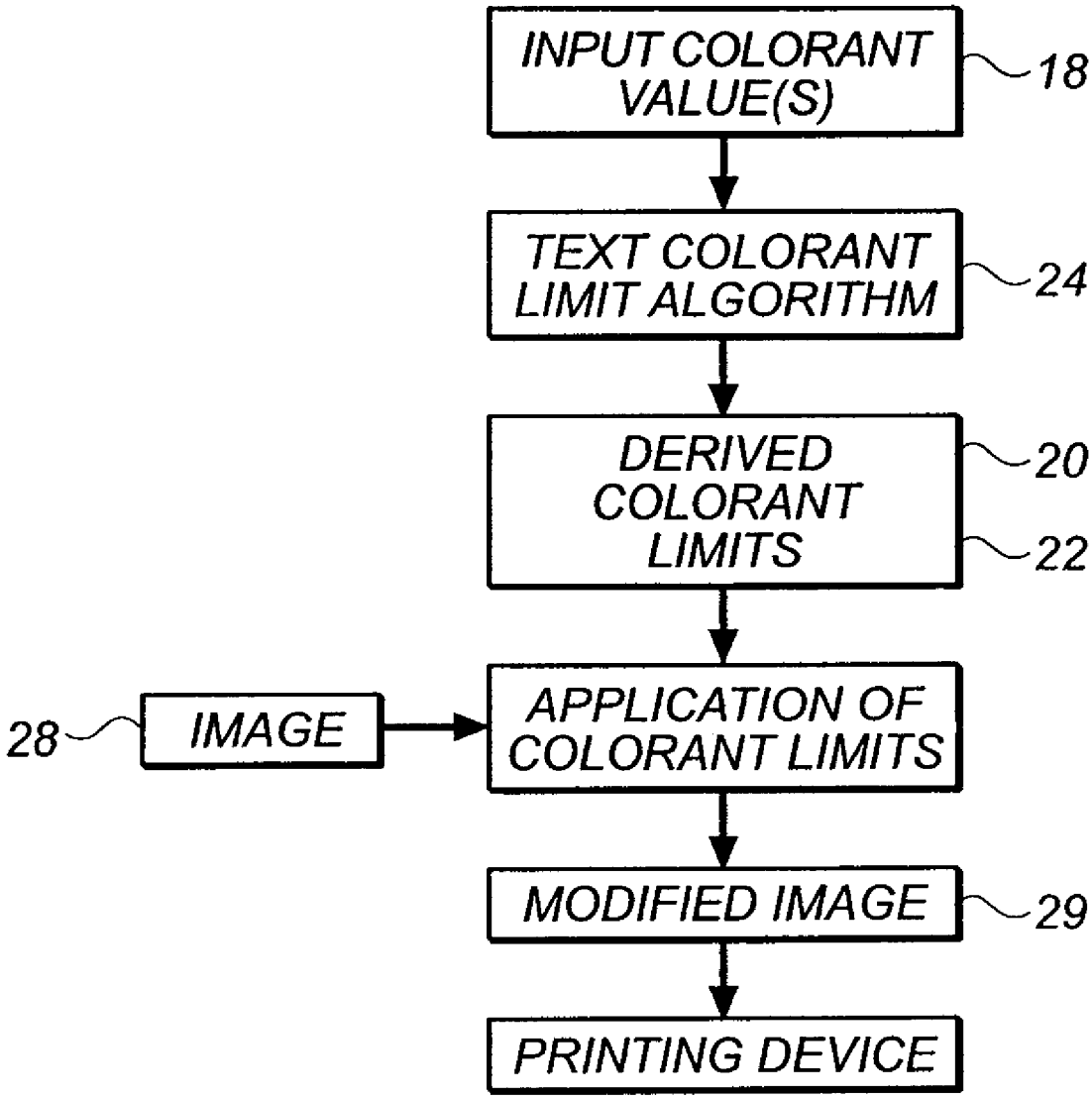
FIG. 3 depicts a block diagram showing the steps of an embodied method.

FIG. 3 shows a schematic of the steps used in the embodied methods. In this embodiment, the maximum amount of colorant that is to be deposited on a specific region of print media to form an image with a reduced quantity of visual defects involves: first inputting a at least one colorant value on the specific region of print media, wherein the at least one colorant value indicates a total amount of at least one colorant that is to be applied by the printing device (10); and then deriving a colorant limit for each color or combinations thereof according to a text ink limit algorithm. The algorithm is referenced as Text Colorant Limit Algorithm (TCLA) 24 and the derived values from use of the TCLA are noted as element 20. Next, each derived color ink limit is applied to an image 28 to limit the quantity of ink used by the printing device when one of the derived colorant limits is exceeded. The result is a modified image 29 that is printed on the printing device, which is preferably a high resolution ink jet printer, such as from Kodak Versamark of Dayton, Ohio.

Figure 4:
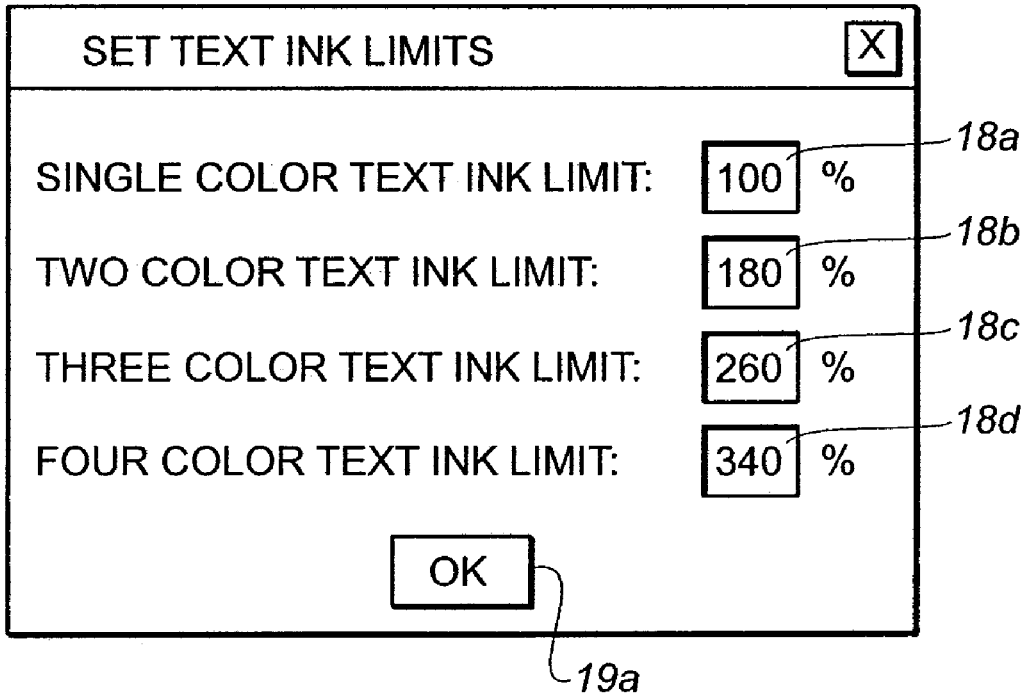
FIG. 4 depicts a preferred embodiment for four colors of an input box for colorant values.

The methods provide the user with a simplified way of producing printed text with optimal quality. FIG. 4 shows a screen shot of a user's input box to utilize the unique sequence of steps. When using the methods herein, optimal ink load values 18*a*, 18*b*, 18*c*, and 18*d* used to print the multi-ink text and results are produced. The ink load values 18*a*, 18*b*, 18*c*, and 18*d* are referred to in FIG. 4 as a single color text ink limit, a two color text ink limit, a three color text ink limit, and a four color text ink limit, respectively.

Figure 5:
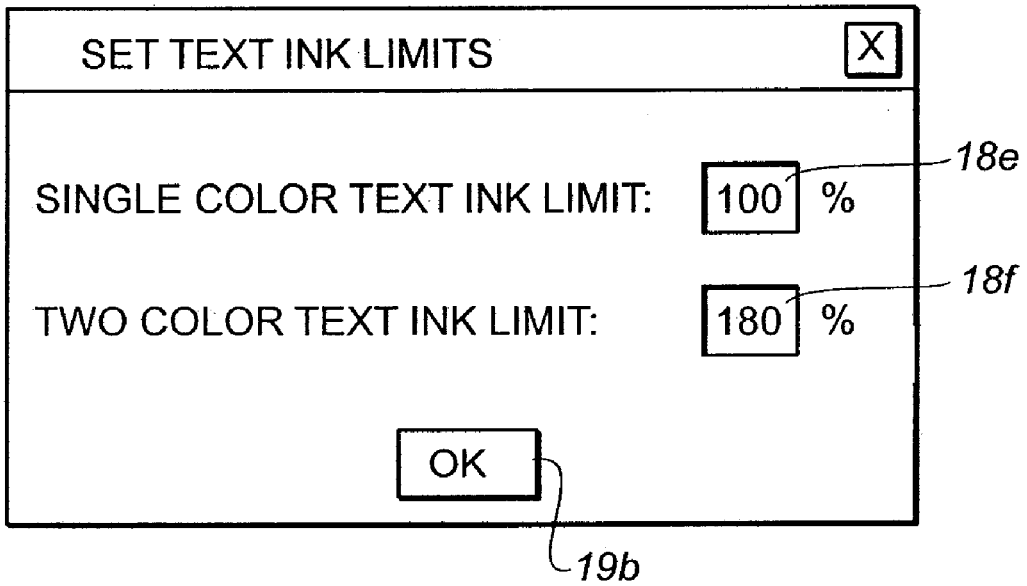
FIG. 5 depicts a preferred embodiment for two colors of an input box for colorant values.

FIG. 5 depict examples of optimal ink loads 18*e*, and 18*f* for four-color and two-color printing, respectively. FIG. 4 and FIG. 5 also show the "OK" buttons 19*a* and 19*b* that are selected once appropriate ink limits are accepted.

Figure 6:
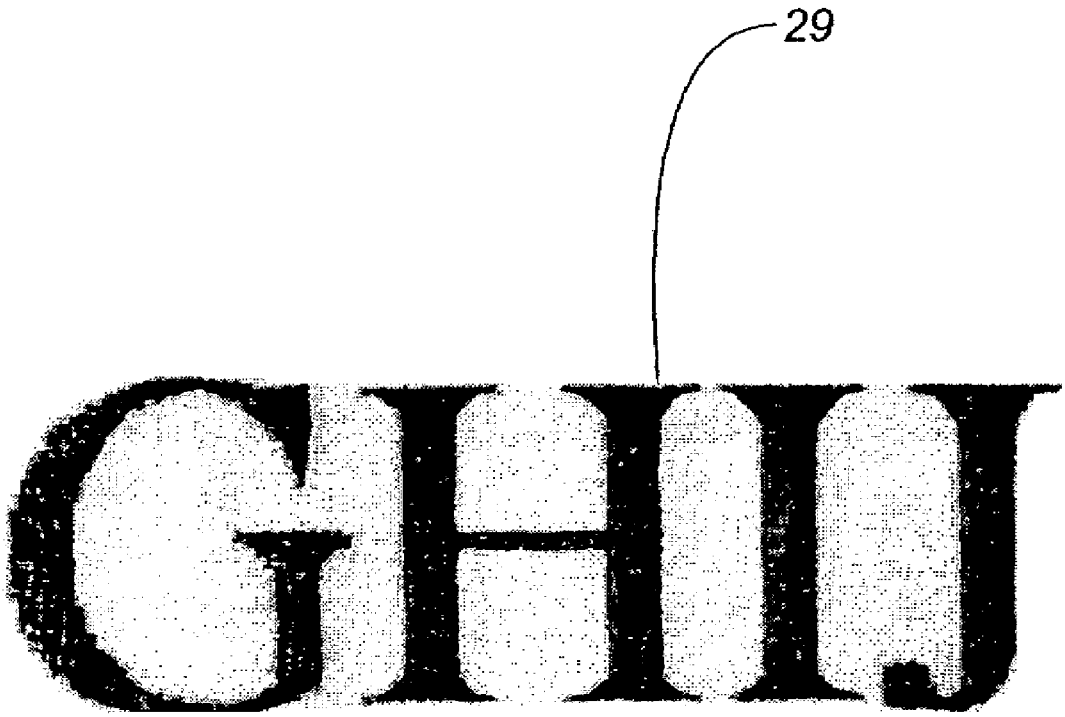
FIG. 6 depicts an image without visual defects created using the derived colorant limits for each color.

FIG. 6 depicts the type of printed output that can be produced when the appropriate ink limits are used to print multi-ink text according to the embodied methods.

The methods are usable printing devices, such as ink jet printers, laser printers, off set printers, and even digital printing machines.

Within the scope of the methods, the print media can be paper, film, cardboard, paperboard, woven fabric, non-woven fabric, vinyl sheets, metallic foil, metalized plastic film, laminates thereof, and similar type materials that accept colorant to form images. The images formed on the print media are typically vector-based images, line art, text images, or combinations thereof.

As depicted in FIG. 3, the method more specifically begins by inputting one or more at least one colorant values 18 on the specific region of print media. The at least one colorant value indicates a total amount (or percentage of the total amount) of at least one colorant that can be applied by the printing device. The at least one colorant value can correspond to a print density specified as a number, such as a value between 0 and 255. The colorant values can be expressed as a percentage greater than 0 and up to 100 of the total amount of at least one colorant that can be applied to the print media.

The method continues by deriving a colorant limit for each color 20 or combinations thereof 22. The colorant limit is derived according to a text ink limit algorithm 24. Typically, the colors 20 used in printing are cyan, magenta, black, yellow, and combinations thereof, but the method is not limited to these specific colors.

The step of deriving of the colorant limit for each color utilizes the equation: $L_i=L_{(i-1)}*(1+a_i)$, wherein $0 \leqq a_i \leqq a_{(i-1)} \leqq 1$. In the equation, Li represe the colorant limit when i number of colorants are applied to the specific region of the print media. $L_{(i-1)}$ represents the colorant limit when (i−1) number of colorants is applied to the specific region of the print media. The equation term ai represents the incremental amounts of additional colorant that can be applied when i number of colorants are increased by one to reach a maximum number of colorants i. The equation term $a_{(i-1)}$ represents the incremental increase in the amount of colorants that can be applied when (i−1) number of colorants are applied to a specific region of the print media, and wherein $i \geqq 2$.

The color limit can be derived for each color utilizing two equations 27 and 30. One equation is $L_3=2*L_2-L_1$, wherein $L_1$ represents the single colorant value and $L_2$ represents a combination of two colorant values 32. The other equation is $L_4=3*L_2-2*L_1$, wherein $L_3$ represents a combination of three colorant values 34 and $L_4$ represents a combination of four colorant values 36.

For example, in a given printing system, the appropriate ink limits for a three color text and a four color text are determined according to the equations: $L_3=2*L_2-L_1$ and $L4=3*L_2-2*L_1$ In these equations, $L_2$ is the ink limit for two-color text ranging from 0% to 200%. Similarly, $L_1$ is the ink limit for single color text ranging from 0% to 100%.

TABLE 1 depicts other example equations and associated inputs and outputs for solving for appropriate ink limits.

| Example | Equations | User Inputs | Derived Limits |
|---|---|---|---|
| 1 | L3 = 2 * L2 − L1 | L1 = 100 | L3 = 260 |
| | L4 = 3 * L2 − 2 * L1 | L2 = 180 | L4 = 340 |
| 2 | L2 = 2 * L1 | L1 = 90 | L2 = 180 |
| | L3 = 3 * L1 | | L3 = 270 |
| | L4 = 4 * L1 | | L4 = 360 |
| 3 | L2 = 0.9 * 2 * L1 | L1 = 100 | L2 = 180 |
| | L3 = 0.9^2 * 3 * L1 | | L3 = 242 |
| | L4 = 0.9^3 * 4 * L1 | | L4 = 292 |

The method ends by applying each derived color ink limit to the image in order to limit the quantity of ink used by the printing device when one of the derived colorant limits is exceeded.

Additionally, hues can be preserved through additional processes of color management, prior to using the algorithm to be used in this method The colorant usable herein can be toner, colored wax, pigment, dye, dye-based ink, water-based ink, oil-based ink, and ink with other solvent bases.

An embodiment of the method can include an algorithm derived from text limits. The algorithm can include coefficients determined from look-up tables. Once text limits have been derived using the method of the algorithm, inking input limits that exceed this threshold are scaled back.

Allocation of derived total limit to the individual primary colors must be determined. The simplest method is to ratio the total ink limit proportionally to each of the individual constituent inks in the text. A more complex method is to apply N-dimensional color management to minimize the error in hue while reducing the colorant levels to the established a threshold that is derived from a look-up table, an algorithm or some combinations thereof.

Look-up table values can be colorant independent, based on color gamut, or other measured physical attributes related to image quality, such as density. The look-up table can be used instead of the algorithm to derive ink limits for text based on physical parameters of the printing system. The look-up tables provide input values of 1-N (that is, 1 through N)color text, wherein the input value is a function of printing on certain substrates with certain inks and other print factors. Additionally, color measurements can be correlated to text ink limits. Color gamut and color saturation are strong indicators of inking levels for text.

For example, two vectors in a color space, one for each color, are measured from white paper to a point of maximum saturation. The look-up table is used to correlate the length of the vectors to ink text limit. Each primary color of multicolor text can have different look-up values based on different table entries corresponding to different vector lengths. Multiple output values from the look-up table usable herein, include variable point sizes and/or the number of primary colors composing the text.

An alternative embodiment of the methods can include look-up tables that are one-dimensional, or look-up tables are based on overall color gamut volume.

Embodiments of the methods extend beyond a text ink limit to a fine line, or fine image usage where the image requires an edge with high acuity. The embodied methods are considered applicable to line art, inked drawing reproduction, or other images where line thickness is important and edge definition is needed.

Additionally, hues can be preserved through additional processes of color management, prior to creating look-up tables to be used in this method.

The embodiments have been described in detail with particular reference to certain preferred embodiments thereof, but it will be understood that variations and modifications can be effected within the scope of the embodiments, especially to those skilled in the art.

PARTS LIST

10. printing device
12*a*. specific region
12*b*. another specific region
14. print media
16. visual defect image
17*a*. first visual defect
17*b*. second visual defect
18. colorant values
18*a*. ink load value/single color text ink limit
18*b*. ink load value/two color text ink limit
18*c*. ink load value/three color text ink limit
18*d*. ink load value/four color text ink limit
18*e*. ink load value/single color text ink limit
18*f*. ink load value/two color text ink limit
19*a*. ok button
19*b*. ok button
20. color element
22. color combinations
24. TCLA algorithm
27. equation
28. image
29. modified image
30. equation
32. two colorant valves

What is claimed is:

1. A method for a printing device, wherein the method determines the maximum amount of colorant to be deposited on a specific region of print media to form an image with a reduced quantity of visual defects, and wherein the method comprises the steps of:

a. inputting a primary colorant value for a single colorant for a single color region of print media, wherein the primary colorant value indicates a percentage of a primary colorant to be applied by the printing device;

b. inputting a secondary colorant value for two single colorants for a two color region of print media, wherein the combined value of the two single colorants indicates a combined percentage of two single colorants to be applied by the printing device;

c. deriving one or more combined color limits, one for each of the number of colorants that can be applied to a single color region of print media according to a text ink limit algorithm; and d. applying each derived color ink limit for the image to limit the quantity of ink used by the printing device when one of the derived colorant limits is exceeded, and wherein the step of deriving of the colorant limit for each color utilizes an equation $L_i=L_{(i-1)}*(1+a_i)$, wherin $0 \leqq a_i \leqq a_{(i-1)} \leqq 1$, wherin $L_i$ represents the colorant limit when i number of colorants are applied to the specific region of the print media, wherein $L_{(i-1)}$ represents the colorant limit when (i−1) number of colorants are applied to the specific region of the print media, wherein $a_i$ represents the incremental amount of additional colorant that is applied when i number of colorants is increased by one to reach a maximum number of colorants i, wherein $a_{(i-1)}$ represents the incremental increase in the amount of colorants that can be applied when (i−1) number of colorants are applied to a specific region of the print media, and wherein $i \geqq 2$.

2. The method of claim 1, wherein at least of one of the colorant values can correspond to a print density specified as a number between 0 and 255.

3. The method of claim 1, wherein at least one of the colorant values can be expressed as a percentage greater than 0 and up to 100 of the total amount of singe colorant that is to be applied to the print media.

4. The method of claim 1, wherein the print media is paper, film, cardboard, paperboard, woven fabric, non woven fabric, vinyl sheets, metallic foil, metalized plastic film, or laminates thereof.

5. The method of claim 1, wherein the visual defects can be bleed, print media deformation, show through, over saturation of color, mottle or combinations thereof.

6. The method of claim 1, wherein the image is vector based, line art, text, or combinations thereof.

7. The method of claim 1, wherein the color is cyan, magenta, black, yellow, or combinations thereof.

8. The method of claim 1, wherein the printing device is an ink jet printer, a laser printer, an off set printer or other printers.

9. The method of claim 1, wherein the method is adapted for digital printing.

10. The method of claim 1, wherein the colorant is toner, colored wax, pigment, dye, dye based ink, water based ink, oil based ink, and ink with other solvent bases.

11. The method of claim 1, wherein the steps of inputting a secondary colorant value, deriving one or more combined color limits, and applying each derived color ink limit are repeated as needed.

12. The method of claim 1, wherein the step of deriving one or more combined color limits is according to a look-up table instead of according to a text ink limit algorithm.

13. The method of claim 12, wherein the look-up tables is one-dimensional.

14. The method of claim 12, wherein the look-up tables is based on the initial single color colorant.

15. The method of claim 12, wherein the look-up tables is based on overall color gamut volume.

16. The method of claim 1, further comprising the step of allocating the derived color ink limits to minimize errors in hue.

17. The method of claim 1, further comprising the step of allocating the derived color ink limits using a look-up table.

* * * * *